United States Patent [19]

Boggs

[11] 4,245,383

[45] Jan. 20, 1981

[54] CENTRIFUGAL PROCESSING APPARATUS WITH REDUCED-LOAD TUBING

[75] Inventor: Daniel R. Boggs, Vernon Hills, Ill.

[73] Assignee: Baxter Travenol Laboratories, Inc.

[21] Appl. No.: 958,902

[22] Filed: Nov. 8, 1978

Related U.S. Application Data

[62] Division of Ser. No. 841,288, Oct. 12, 1977, Pat. No. 4,164,318.

[51] Int. Cl.[3] ..... B21D 39/03

[52] U.S. Cl. ..... 29/428; 264/164; 264/167; 264/173; 264/288.8; 264/291

[58] Field of Search ..... 264/291, 173, 167, 164, 264/174, 177 F, 523, 573, 541; 233/23 R; 29/428

[56] References Cited

U.S. PATENT DOCUMENTS

| | | | |
|---|---|---|---|
| 2,230,151 | 1/1941 | Winder | 264/523 |
| 2,338,210 | 1/1944 | Snyder | 264/291 |
| 2,608,722 | 9/1952 | Stuetzer | 264/291 |
| 2,802,530 | 8/1957 | Kaufman | 264/573 |
| 2,965,925 | 12/1960 | Dietzsch | 425/382.2 |
| 3,184,822 | 5/1965 | Shaw | 264/177 F |
| 3,264,383 | 8/1966 | Niessner et al. | 264/541 |
| 3,394,213 | 7/1968 | Roberts et al. | 264/177 F |
| 3,493,459 | 2/1970 | McIntosh et al. | 264/177 F |
| 3,518,019 | 6/1970 | Nakamura | 264/177 F |
| 3,577,987 | 5/1971 | Bronnenkant | 264/291 |
| 3,607,185 | 9/1971 | Andrysiak et al. | 264/177 F |
| 3,825,641 | 7/1974 | Barnett | 264/177 R |
| 4,138,457 | 2/1979 | Rudd et al. | 264/541 |

FOREIGN PATENT DOCUMENTS

| | | | |
|---|---|---|---|
| 1090084 | 3/1955 | France | 264/291 |
| 38-8581 | 6/1963 | Japan | 264/173 |

*Primary Examiner*—Jay H. Woo

*Attorney, Agent, or Firm*—Paul C. Flattery; John A. Caruso; George H. Gerstman

[57] ABSTRACT

Centrifugal processing apparatus in which a processing chamber is rotatably mounted with respect to a stationary base. An umbilical cable segment is fixed at one end substantially along the axis of the processing chamber at one side thereof, with the other end of the cable segment being attached substantially on the axis in rotationally locked engagement to the processing chamber. The cable segment comprises flexible tubing which defines a plurality of parallel longitudinal channels, with the cable segment having been stretched in the central portion thereof so that the central portion is narrower in cross-sectional dimensional area than the ends of the cable segment. In this manner, the channels remain large enough for effective connection of tubing to the walls defining the channels and the load of the umbilical tubing becomes substantially reduced.

3 Claims, 8 Drawing Figures

FIG. 1
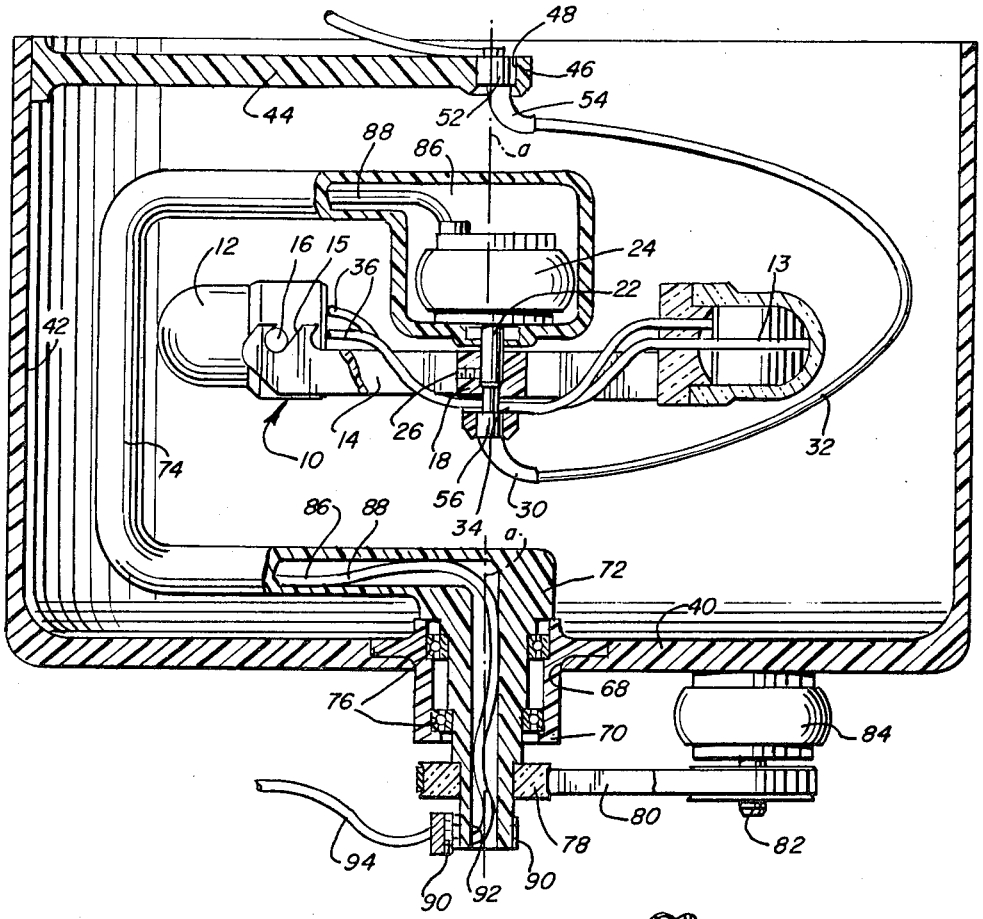
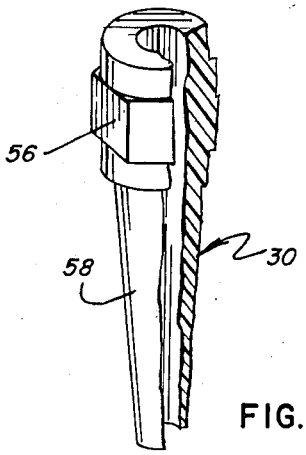
FIG. 2
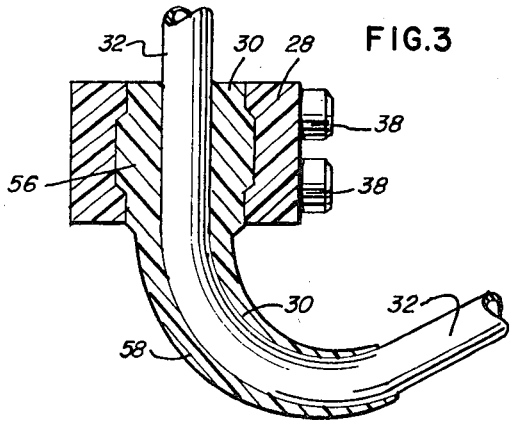
FIG. 3
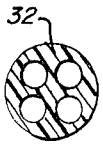
FIG. 4

FIG. 5
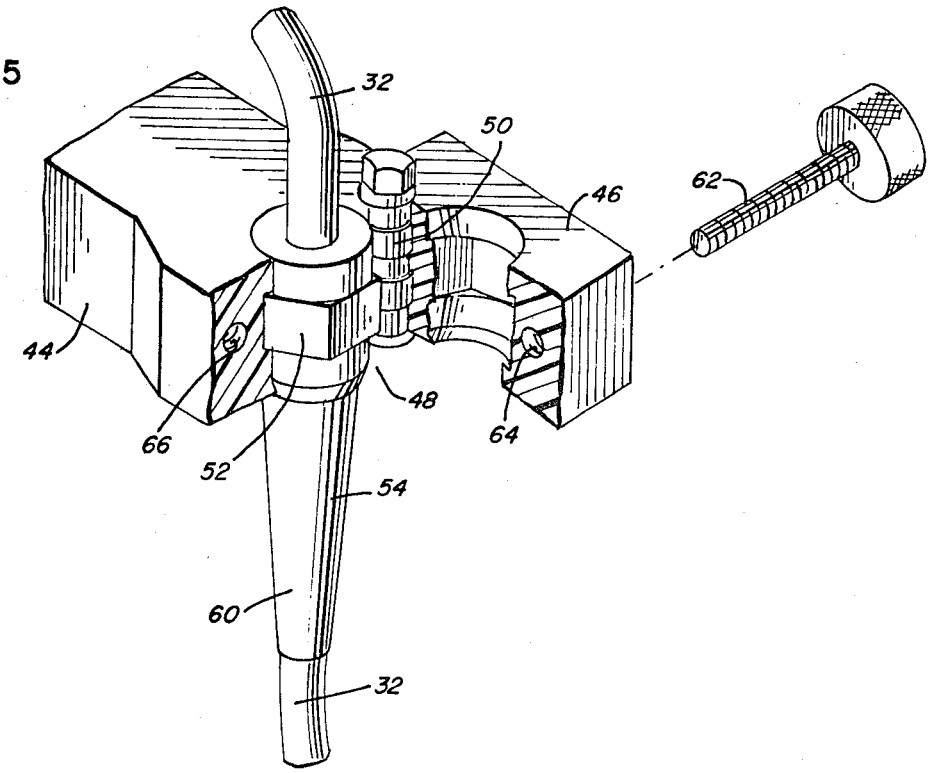
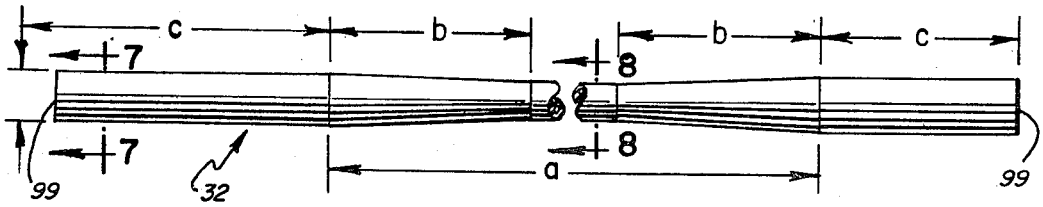
FIG. 6
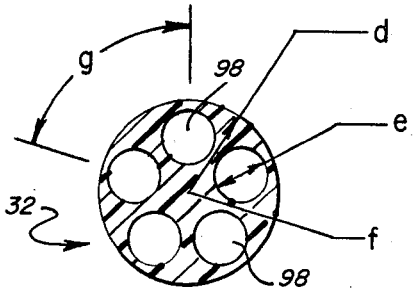
FIG. 7
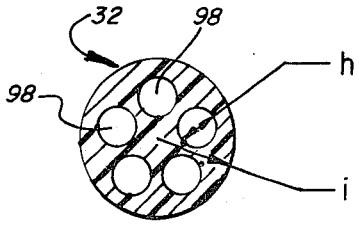
FIG. 8

CENTRIFUGAL PROCESSING APPARATUS WITH REDUCED-LOAD TUBING

This is a division of application Ser. No. 841,288 filed Oct. 12, 1977, now U.S. Pat. No. 4,164,318.

BACKGROUND OF THE INVENTION

The present invention concerns centrifugal processing apparatus and, more particularly, apparatus employing umbilical tubing which is rotated with respect to a stationary base.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining red blood cell component in a liquid medium, such as glycerol. Prior to use, the glycerolized red blood cells are thawed and pumped into the centrifugating wash chamber of a centrifugal liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red blood cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principles of operation described in Dale A. Adams U.S. Pat. No. 3,686,413. The apparatus of the Adams patent established fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

Typically the umbilical tube is formed of multiple lumen plastic tubing, such as plastic tubing having a circular cross-sectional configuration and defining four or five longitudinal channels. A small tube is connected to each of the walls defining each of the channels, with each of the small tubes being used to carry either the blood or the solutions used in connection with the blood.

It has been found to be desirable that the tubing have an internal diameter that is sufficiently large so as to prevent damage to the blood cells. It has also been found desirable that the channels defined by the flexible tubing have a diameter which is sufficiently large so as to enable the small tubing to be effectively fastened to the walls defining these channels. It has been found essential that the cable segment maintains sufficient integrity so that during operation of the centrifugal processing apparatus the motions of the cable segment do not cause rupture thereof.

On the other hand, cable segments having the desirable properties mentioned above have required a relatively large cross-sectional area, thereby presenting a significant load to the system during operation. Stress resulting from such substantial load has caused deterioration and fracture of the tubing and/or the components involved with the tubing. It was thus determined that a reduction in the weight of the umbilical tube would be required, without correspondingly reducing the other characteristics of the tubing so as to render the tubing incapable of handling proper blood flow and incapable of being properly assembled.

It is, therefore, an object of the invention to provide umbilical tubing for centrifugal processing apparatus, with the umbilical tubing having reduced load characteristics.

A further object of the present invention is to provide umbilical tubing for centrifugal processing apparatus, in which the umbilical tubing has a cross-sectional area at its ends which is large enough to enable effective connection of small tubing to the walls defining longitudinal channels in the umbilical tubing.

Another object of the present invention is to provide centrifugal processing apparatus in which the umbilical tubing has sufficient integrity for effective operation, yet is relatively lightweight so as to reduce the load on the system.

Other objects and advantages of the present invention will become apparent as the description proceeds.

BRIEF DESCRIPTION OF THE INVENTION

In accordance with the present invention, centrifugal processing apparatus is provided which comprises a stationary base and a processing chamber rotatably mounted with respect to the base for rotation about a predetermined axis. A flexible umbilical cable segment is provided for establishing communication with the processing chamber. One end of the cable segment is fixed with respect to the base substantially along the axis at one side of the processing chamber. The cable segment extends around the processing chamber with the other end of the cable segment attached substantially on the axis in rotationally locked engagement to the processing chamber.

The cable segment comprises flexible tubing which defines a plurality of parallel longitudinal channels. The cable segment has a first cross-sectional area dimension adjacent both ends thereof and a second cross-sectional area dimension in the central portion thereof. The second cross-sectional area dimension is smaller than the first cross-sectional area dimension with the corresponding dimensions within the cross-sectional planes of the first and second cross-sectional areas being in substantial proportion to each other.

In the illustrative embodiment, the flexible tubing has a generally circular cross-sectional configuration and defines at least four of the channels, and the second cross-sectional area extends along a major portion of the cable segment.

In the method of the present invention for forming the cable segment, a flexible plastic tube is initially provided, with the tube defining a plurality of longitudinal channels. Heat is applied to a portion of the tubing and the tubing is stretched longitudinally to provide a cable segment with a portion thereof having a smaller cross-sectional area dimension than the cross-sectional area dimension on opposite sides of the stretched portion. In this manner, the cross-sectional dimensions of the channels with respect to the tubing at the central portion thereof remain proportional to the cross-sectional dimensions of the channel at the ends of the tubing. Thus the channel dimensions at the ends of the tubing are sufficiently large so that tubes can be effectively fastened to the walls defining the channels and such tubes may have an internal diameter that is sufficiently large to provide satisfactory blood flow, while at the same time the overall weight of the umbilical cable segment is substantially reduced.

A more detailed explanation of the invention is provided in the following description and claims, and is illustrated in the accompanying drawings.

BRIEF DESCRIPTION OF THE DRAWINGS

FIG. 1 is an elevational view, taken partially in cross-section for clarity, of centrifugal processing apparatus constructed in accordance with one embodiment of the present invention;

FIG. 2 is an elevational view, partially broken for clarity, of a flexible sheath used in connection with the centrifugal processing apparatus of the present invention;

FIG. 3 is a view, taken partially in cross-section, of a two ω flexible sheath holder constructed in accordance with the principles of the present invention;

FIG. 4 is a cross-sectional view of a cable segment constructed in accordance with the principles of the present invention;

FIG. 5 is a perspective view, with portions broken for clarity, of a flexible sheath and torque arm connector, constructed in accordance with the principles of the present invention;

FIG. 6 is a partially broken front view of an umbilical cable segment constructed in accordance with the principles of the present invention, without the flexible sheath members being attached at opposite ends thereof;

FIG. 7 is a cross-sectional view thereof, taken along the plane of the line 7—7 of FIG. 6; and FIG. 8 is a cross-sectional view thereof, taken along the plane of the line 8—8 of FIG. 6.

DETAILED DESCRIPTION OF THE ILLUSTRATIVE EMBODIMENT

Referring to the drawings, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitable insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 10. Processing chamber 10 includes a pair of buckets 12, 13 which are mounted in diametrically opposed positions. Buckets 12, 13 are mounted on a cradle 14 which is rotatable about a central axis a. The opposed ends of cradle 14 define slots 15 into which pins 16 carried by buckets 12, 13 may be connected.

The central portion of cradle 14 defines a ring or hub 18, defining a central axial bore 20 for receiving the shaft 22 of an electrical motor 24. Shaft 22 is keyed to hub 18 by a set screw 26 or other suitable fastening means.

Hub 18 carries a sheath holder 28, which sheath holder 28 defines a central bore for receiving a sheath 30 which surrounds a portion of umbilical cable segment 32. Holder 28 defines radial openings 34 for permitting tubes 36, which extend from umbilical cable 32, to pass from cable 32 through openings 34 to buckets 12, 13. While holder 28 is fixed to hub 18, as shown most clearly in FIG. 3, the holder 28 may be hinged and opened by loosening screws 38, thereby permitting release of sheath 30, associated cable segment 32 and tubes 36 from the cradle 14. Thus to remove buckets 12 and 13 and their associated tubes 36 from the assembly, pins 16 are removed from slots 15, screws 38 are loosened to allow sheath 30 and associated cable segment 32 to be removed from holder 28 and hub 18, thereby simply releasing the buckets and cable segment from the drive mechanism without requiring passage of tubing or other elements through a central hollow shaft.

A stationary base 40 is provided, comprising a bowl 42 with a stationary or fixed torque arm 44 connected to a side of the bowl 42 and extending to a position whereby the distal end 46 of torque arm 44 defines an opening 48 that is coaxial with axis a to receive a fixed end of cable segment 32. Torque arm 44 is hinged at 50 so as to receive the polygonal base 52 of a flexible sheath 54. Flexible sheath 54 defines a central axial bore which receives cable segment 32 snugly therein. Although not essential, in the illustrative embodiment flexible sheath 30 and flexible sheath 54 are identical, with each comprising a polygonal base 56, 52, respectively, a flexible shank portion 58, 60, respectively, and a central axial bore for snugly receiving cable segment 32.

Flexible sheath 54 is clamped to torque arm 44 by means of the hinged assembly with end 46 swinging about hinge 50 and being secured by a manually-graspable bolt 62 which extends through slot 54 and into slot 66 of torque arm 44, thereby grasping base 52 for securement of the flexible sheath and its associated cable 32 from the torque arm 44 as readily apparent from FIG. 5.

The bottom portion of base 40 defines an opening 68 for receiving a bearing housing 70. Bearing housing 70 surrounds the lower portion 72 of a one ω turn arm 74, which turn arm 74 is rotatable about axis a. Turn arm 74 is coupled to base 40 by a pair of ball bearings 76. A pulley 78 is keyed to lower portion 72 of turn arm 74 and is coupled by belt 80 to the shaft 82 of electric motor 84 which is fixed to base 40. Shaft 82 is set to rotate at one ω so as to cause one ω rotation of turn arm 74 about axis a.

As used herein, the term "one ω" signifies any rotational velocity and is used as a relative term so that the term "two ω" is used to designate an angular velocity twice the angular velocity of one ω.

Turn arm 74 defines a central bore 86 through which electrical wires 88 extend for connection to electric motor 24. Electrical power is transmitted to electrical lines 88 by means of brushes 90 which are electrically connected to electrical line 94 which is coupled to a suitable source of electric energy. During rotation of turn arm 74 and its lower portion 72, brushes 90 will engage terminals 92 to transmit electrical energy via line 94, brushes 90, terminals 92 and line 88 to electrical motor 24.

In order for motor 24 and motor 84 to be speed synchronized, a pair of additional control leads may be coupled from the motor 24 to terminals 92. Two additional brushes 90 are coupled to a tachometer-feedback circuit for providing appropriate feedback information to motor 24 so as to synchronize motor 24 with motor 84. In this manner, shafts 22 and 82 will both have one ω synchronized rotation.

Fluid communication with buckets 12 and 13, which rotate as part of processing chamber 10, and with the non-rotating portions of the centrifugal processing system, is provided by the umbilical cable or tubing 32. Cable 32 defines separate passageways or conduits therein, with a cross-sectional configuration of cable 32 being shown in FIGS. 4, 7 and 8. Tubing 32 could be circular or polygonal in cross-sectional configuration. Tubes 36 extend from the openings defined by tubing 32, for communication to and from buckets 12 and 13, as discussed above.

Cable 32 is suspended from a point above and axially aligned with processing chamber 10 by means of its fixed connection to torque arm 44 through flexible sheath 54 which acts to relieve the strain. A segment of cable 32 extends downwardly from its axially fixed position, radially outwardly, downwardly and around, and then radially inwardly and upwardly back to the processing chamber 10. The other end of cable 32 is fixed to an axial position by its connection to the holder 28 and it also carries a strain relief sheath 30, similar to strain relief sheath 54.

In order to reduce the load created by the umbilical cable segment 32 during operation of the device, the cross-sectional area dimension of the central portion of the cable segment 32 is reduced, while the ends of the cable segment remain large enough to enable tubes 36 to be fastened to the walls defining the longitudinal channels extending through the flexible tubing which composes the cable segment. Referring to FIGS. 6–8 in particular, it is seen that portions c, which are generally the outer ends of the cable segment, have a relatively large circular cross-sectional configuration while portion a, which is central with respect to portions c, has a smaller circular cross-sectional configuration, with the dimension tapering toward the center along portion b and the most centrally located portion of the cable segment 32 having the smallest cross-sectional dimension.

In the FIGS. 6–8 embodiment, cable segment 32 defines five equi-spaced longitudinal channels 98. Tubes 36 are fastened to the walls defining channels 98 adjacent ends 99 of cable segment 32. In order for an effective assembly operation to occur, it is necessary for the cross-sectional area of channels 98, at ends 99, to be large enough to receive tubes 36. Further, it is important for tubes 36 to have a sufficient internal diameter so as to permit proper flow of the blood without causing damage to the blood cells as a result of improper constriction. However, the cross-sectional dimensions required at ends 99 have been found to be too large for the cross-sectional dimension of the central portion of the cable segment 32.

In order to reduce the load on the system, thermoplastic tubing, such as PVC tubing, is heated and stretched to provide the desired dimensions. In the illustrative embodiment, PVC tubing, having a uniform circular cross-sectional configuration and defining five longitudinal channels, was stretched to provide a central portion having a significantly smaller cross-sectional area dimension than the cross-sectional are dimension at ends 99. By stretching the tubing, the dimensions of channels 98 with respect to the tubing dimensions remain proportional throughout the length of the cable segment.

In one method of producing the cable segment, a section of such PVC tubing was heated in an oil bath at 375° C. and was stretched to the desired dimensions. In another method, a section of the PVC tubing was heated in an infrared oven with subsequent stretching. The temperatures required during the heating step were above the normal working temperature of the thermoplastic material so as to allow the thermoplastic tubing to be stretched while it is in its "soft" state.

Flexible sheaths 30 and 54 are applied adjacent the ends of cable segment 32 after the tubing is stretched and cooled, although the specific manner of fastening the flexible sheaths to cable segment 32 forms no part of the present invention.

In another method of producing the cable segment, PVC is extruded through a conventional continuous extrusion die for forming the multilumen tubing. However, at the time that the tubing is to be reduced in thickness the take-up speed from the die is increased. The take-up speed is then reduced at the times that the tubing is to have its thicker diameter.

In order for the blood and solutions to flow without undue restriction, it is preferred that the internal diameter of the flow path be at least 0.08 inch. Thus it is preferred that the central portion of cable segment 32 be stretched no further than to an extent wherein channels 98 have an internal diameter of 0.08 inch at the central portion. On the other hand, in order for tubing 36 to have a sufficiently large internal diameter and be relatively simple to assemble to tubing 32, it is preferred that channels 98 at ends 99 have an internal diameter of at least 0.1 inch. Thus in a preferred embodiment, although no limitation is intended or should be implied, the FIGS. 6–8 dimensions are as follows in a specific example:

| Reference Letter | Dimension |
|---|---|
| a | 20 inches |
| b | 4.5 inches |
| c | 5 inches |
| d | 0.19 inch |
| e | 0.105 inch |
| f | 0.111 inch |
| g | 72° |
| h | 0.08 inch |
| i | 0.145 inch |

It is to be understood while circular cross-sectional configurations are shonw, other cross-sectional configurations, e.g., elliptical or polygonal, might be found satisfactory. Further, no limitation is intended with the type of flexible material forming cable segment 32.

In the operation of the system, when electric motors 24 and 84 are energized, shafts 22 and 82 will rotate at one ω. The one ω rotation of shaft 84 will cause turn arm 74 to rotate at one ω about axis a. The one ω rotation of turn arm 74 about axis a, combined with the one ω rotation of shaft 22 also about axis a, will cause two ω rotation of processing chamber 10. At the same time, cable segment 32 will be rotating at one ω about axis a.

Although turn arm 74 is shown as a single arm in the illustrative embodiment, in order to enhance the stability of the system it is desirable that appropriate counterbalancing means be used. To this end, turn arm 74 could take the form of three equilateral arms forming a spider-like configuration. Additionally, turn arm 74 could take the form of a half shell or could comprise two opposed arms for balance. It is to be understood that other counterbalancing structural configurations may be employed if desired.

Although an illustrative embodiment of the invention has been shown and described, it is to be understood that various modifications and substitutions may be made by those skilled in the art without departing from the novel spirit and scope of the present invention.

What is claimed is:

1. A method for reducing the load of flexible umbilical cable segment used with centrifugal processing apparatus, which comprises the steps of:

providing an elongated flexible plastic tube defining a plurality of longitudinal channels;

applying heat to a portion of said tube;

stretching said heated portion longitudinally to provide a cable segment with the stretched portion having a smaller cross-sectional area dimension than the cross-sectional area dimensions of the portions on opposite ends of the stretched portion;

fastening a tube to each of the walls defining said channels at the ends of said umbilical cable segments;

fastening flexible sheath members adjacent each end of said flexible umbilical cable segment; and connecting said umbilical cable segment to centrifugal processing apparatus.

2. A method for reducing the load of flexible umbilical cable segment used with centrifugal processing apparatus, which comprises the steps of:

extruding through an extrusion die a thermoplastic material to provide an elongated flexible plastic tube defining a plurality of longitudinal channels;

taking up the extrudate from the die at a first speed to obtain first tube portions having a predetermined cross-sectional area dimension;

at selected times during the extrusion, taking up the extrudate from the die at an increased speed to obtain second tube portions having smaller cross-sectional area dimension than said predetermined cross-sectional area dimension, said second tube portions being intermediate said first tube portions;

fastening a tube to each of the walls defining said channels at the ends of said umbilical cable segment;

fastening flexible sheath members adjacent each end of said flexible umbilical cable segment; and connecting said umbilical cable segment to centrifugal processing apparatus.

3. A method for reducing the load of flexible umbilical cable segment used with centrifugal processing apparatus, which comprises the steps of:

feeding a thermoplastic material to an extrusion die;

extruding said thermoplastic material through said die to provide an elongated flexible plastic tube defining a plurality of longitudinal channels;

working said thermoplastic material during said extrusion process to provide a cable segment with a first portion having a smaller cross-sectional area dimension than the cross-sectional area dimensions of the portions on opposite sides of said first portion;

fastening a tube to each of the walls defining said channels at the ends of said umbilical cable segment;

fastening flexible sheath members adjacent each end of said flexible umbilical cable segment; and connecting said umbilical cable segment to centrifugal processing apparatus.

* * * * *